United States Patent [19]

Nishibe

[11] 4,236,434

[45] Dec. 2, 1980

[54] APPARATUS FOR PRODUCING A VOCAL SOUND SIGNAL IN AN ELECTRONIC MUSICAL INSTRUMENT

[75] Inventor: Koji Nishibe, Saitama, Japan

[73] Assignee: Kabushiki Kaisha Kawai Sakki Susakusho, Hamamatsu, Japan

[21] Appl. No.: 31,482

[22] Filed: Apr. 19, 1979

[30] Foreign Application Priority Data

Apr. 27, 1978 [JP] Japan ..... 53-4929553
Apr. 28, 1978 [JP] Japan ..... 53/5081553
Apr. 28, 1978 [JP] Japan ..... 53/5081653

[51] Int. Cl.[3] ..... G10H 1/00; G10H 1/12; G10H 5/00

[52] U.S. Cl. ..... 84/1.19; 84/1.11; 84/1.13; 84/1.25; 84/1.26; 84/DIG. 9; 179/1 SG

[58] Field of Search ..... 84/1.11–1.13, 84/1.19, 1.21, 1.25, 1.26, DIG. 9, DIG. 23; 179/1 SG, 1 SA

[56] References Cited

U.S. PATENT DOCUMENTS

| | | | |
|---|---|---|---|
| 3,519,720 | 7/1970 | Bunger | 84/1.12 |
| 3,668,294 | 6/1972 | Kameoka et al. | 179/1 SA X |
| 3,749,807 | 7/1973 | Adachi | 84/1.19 X |
| 3,767,834 | 10/1973 | Hebelsen et al. | 84/1.19 |
| 3,836,693 | 9/1974 | Ichikawa | 84/1.19 |
| 3,897,709 | 8/1975 | Hiyoshi et al. | 84/1.19 |
| 3,974,461 | 8/1976 | Luce | 84/1.11 X |
| 3,986,426 | 10/1976 | Faulhaber | 84/1.25 X |
| 4,023,455 | 5/1977 | Peterson | 84/1.21 |
| 4,074,605 | 2/1978 | Shigeta et al. | 84/1.19 X |
| 4,079,653 | 3/1978 | Finch | 84/1.11 X |
| 4,106,384 | 8/1978 | Whittington et al. | 84/1.19 |
| 4,187,397 | 2/1980 | Modena et al. | 179/1 SG |

*Primary Examiner*—Stanley J. Witkowski
*Attorney, Agent, or Firm*—Haseltine, Lake & Waters

[57] ABSTRACT

An electronic musical instrument for producing a vocal sound signal comprising a musical tone signal generator connected to a passing circuit for passing a musical tone signal under the selection of a key. A formant filter is connected in the passing circuit and includes a plurality of filters connected in parallel to one another. A control system is operative to produce two output signals in the passing circuit after the formant filter in sequence upon operation of the key, one of the output signals being a vowel sound and the other a consonant sound.

9 Claims, 16 Drawing Figures

FIG.1
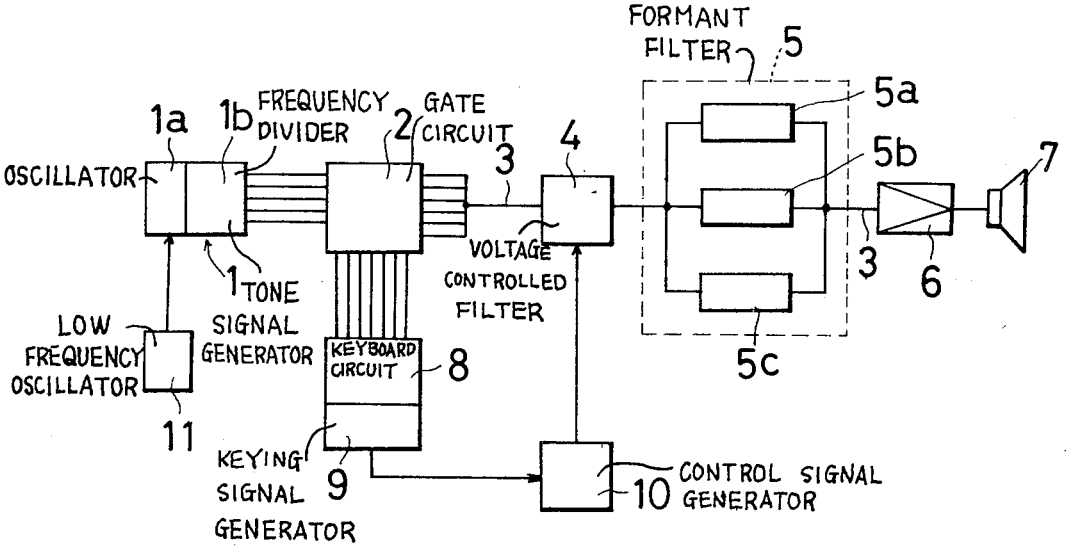
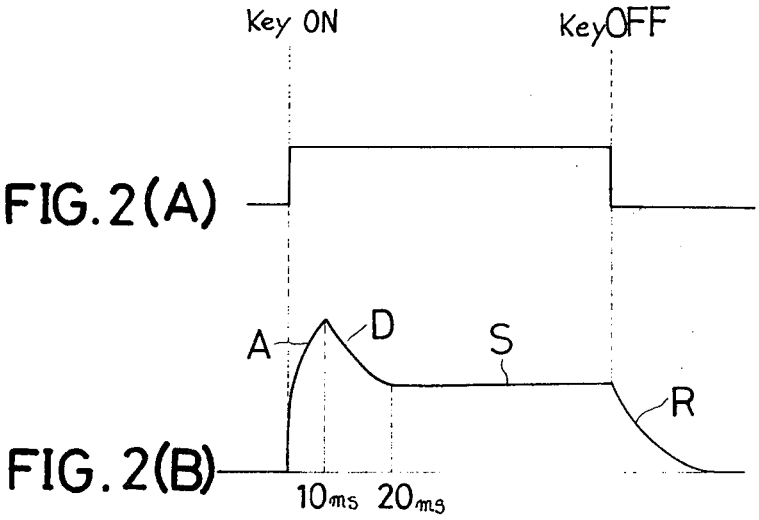

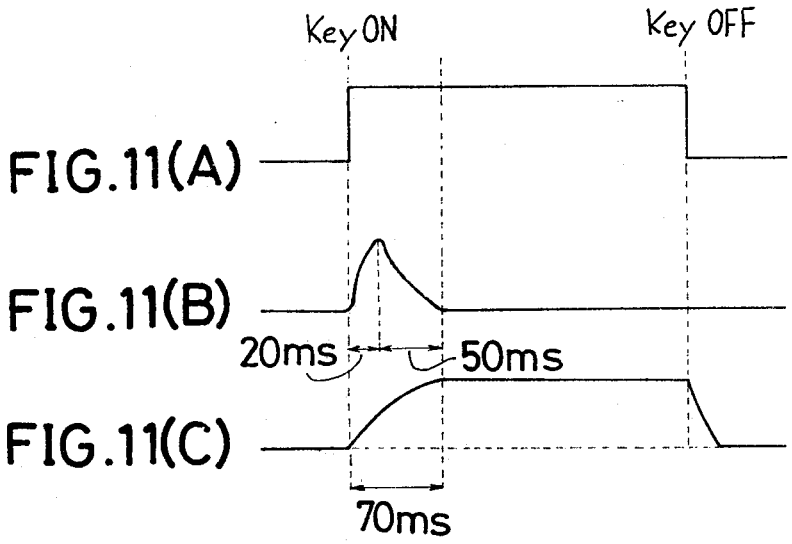
FIG.13
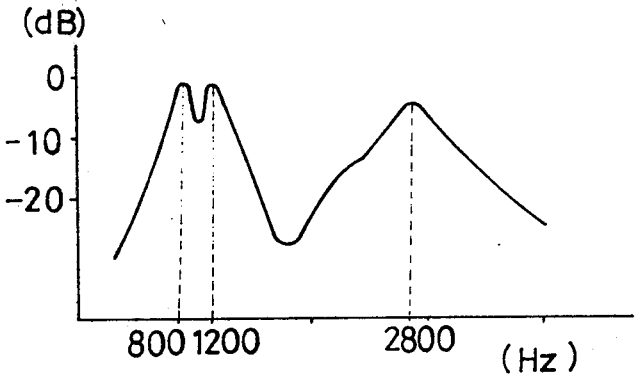

APPARATUS FOR PRODUCING A VOCAL SOUND SIGNAL IN AN ELECTRONIC MUSICAL INSTRUMENT

BACKGROUND OF THE INVENTION

This invention relates to an apparatus for producing a vocal sound signal in an electronic musical instrument.

PRIOR ART

It has been known from a study of speech sounds that sounds resembling the human voice can be produced by using a formant filter. However, there has not yet been produced a simple apparatus for producing a consonant and subsequently thereto a vowel.

SUMMARY OF THE INVENTION

An object of the invention is to provide a simple apparatus for producing a consonant and a vowel subsequent thereto.

According to a first feature of this invention, in an apparatus in which a formant filter comprising plural filters connected in parallel to one another is interposed in a passing circuit for a musical tone signal obtained from a musical tone signal generator by operation of a key, a voltage controlled type filter is connected before or after the formant filter, and a control electrode thereof is connected to an output terminal of a control signal generating circuit arranged to be operated by the operaton of the key, so that a peak of the voltage controlled type filter is shifted to one side by an attack signal of an output of the control signal generating circuit and is shifted to the other side by a decay signal subsequent to the attack signal.

According to a second feature of this invention, in an apparatus in which a formant filter comprising plural filters connected in parallel to one another is interposed in a passing circuit for a musical tone signal obtained from a musical tone signal generator by operation of a key, at least one of said plural filters of the formant filter is composed of a voltage controlled type filter and is so arranged that, by an output signal of a control signal generating circuit arranged to be operated by operation of the key, a peak thereof is shifted from a lower frequency to a higher frequency and is then set in a sustained condition.

According to a third feature of this invention, in an apparatus in which a formant filter comprising plural filters connected in parallel to one another is interposed in a passing circuit for a musical tone signal obtained from a musical tone signal generator by operation of a key, the formant filter comprises a first formant filter for a consonant and a second formant filter for a vowel and said first and second formant filters are interposed in the passing circuit through first and second gates, respectively, and further there are provided first and second control signal generating circuits arranged to be operated by the operation of the key, and respective output terminals of the first and second control signal generating circuits are connected to respective control electrodes of the first and second gates so that at the moment when the key is operated, the first gate is opened to produce a consonant signal, and sequentially to the consonant signal the second gate is opened to produce a vowel signal.

BRIEF DESCRIPTION OF THE FIGURES OF THE DRAWING

FIG. 1 is a block diagram showing one embodiment of this invention,

FIG. 2 (A) is an output characteristic diagram of a keying signal generator, FIG. 2 (B) is an output characteristic diagram of a control signal generator, FIG. 13 is a characteristic diagram of a formant filter for a vowel.

DETAILED DESCRIPTION

Figure 3:
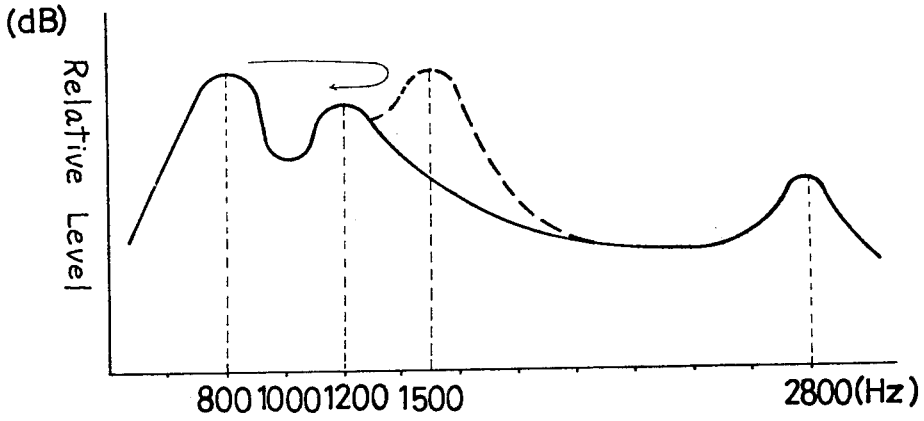
FIG. 3 is characteristic diagram of a formant filter.

Referring to FIG. 1 showing one embodiment of the invention, numeral 1 denotes a musical tone signal generator comprising a main oscillator 1*a* and a frequency divider l*b* . A plurality of output terminals of devider 1*b* are connected through a gate circuit 2 to a common passing circuit 3 for a musical tone signal. A voltage controlled type filter 4 and a formant filter 5 comprising plural filters 5*a*, 5*b*, 5*c* connected in parallel one to another are interposed in series in the passing circuit 3. An output terminal of the passing circuit 3 is connected through an amplifier 6 to a speaker 7.

Numeral 8 denotes a keyboard circuit, and numeral 9 denotes a keying signal generator provided in the keyboard circuit 8. An output terminal of the keying signal generator 9 is connected to a control signal generator 10, and an output terminal of the generator 10 is connected to a control electrode of the voltage controlled type filter 4.

The musical tone signal generator 1 is arranged to generate a waveform includng a number of harmonic wave components such as a saw-toothed wave, a pulse wave or the like. The control signal generator 10 is so arranged that a control signal comprising an attack signal A, a decay signal D, a sustaining signal S and a release signal R as shown in FIG. 2 (B), which is a so-called envelope signal, may be generated by a keying signal as shown in FIG. 2 (A) generated from the keying signal generator 9.

Figure 4:
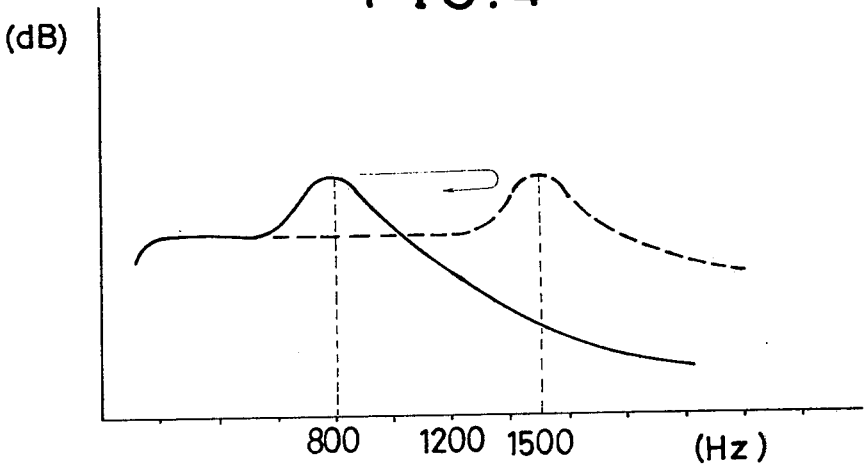
FIG. 4 is a characteristic diagram of a voltage controlled filter.

If it is now intended to generate a vocal sound "PA", the respective filters 5*a*, 5*b*, 5*c* of the formant filters 5 are so set as to have peaks at 800 Hz, 1200 Hz and 2800 Hz, respectively, as shown in FIG. 3. Additionally, the voltage controlled type filter 4 is so set that, as shown in FIG. 4, the filter 4 has a peak near 800 Hz at the sustaining signal S of the control signal of the control signal generator 10, and the peak may be shifted to 1500 Hz at the attack signal A and be shifted back to 800 Hz at the decay signal D.

If, with the above arrangement, the keyboard circuit 8 is operated by operation of a keyboard, a corresponding gate of the gate circuit 2 is opened and a corresponding musical tone signal is applied to the passing circuit 3. Meanwhile, the keying signal (FIG. 2(A)) is generated by the keying signal generator 9, and the control signal (FIG. 2(B)) is generated by the control signal circuit 10, so that, as shown in FIG. 4, the peak of the voltage controlled type filter 4 is shifted from 800 Hz to 1500 Hz by the attack signal A of the control signal, and sequentially thereto is shifted from 1500 Hz by the decay signal D thereof and remains at 800 Hz by the sustaining signal D. Thus, in the formant filter 5 the peak at 800 Hz is shifted to 1500 Hz as shown by the dotted lines in FIG. 3 and is moved back to 800 Hz. During this operation, the sound of the consonant "P" is produced, and emitted from the speaker 7. When the peak settles at 800 Hz, the vowel sound "A" is produced and emitted. Consequently, the vocal sound "A" is produced.

For producing other vocal sounds, for instance, "PI", "PU", "PE", "PO", the respective filters 5*a*, 5*b*, 5*c* of the formant filter 5 are set as shown in the following Table 1.

TABLE 1

| | Filter (5a) | Filter (5b) | Filter (5c) |
|---|---|---|---|
| PA | 800 Hz | 1200 Hz | 2800 Hz |
| PI | 250 Hz | 2200 Hz | 3800 Hz |
| PU | 250 Hz | 1500 Hz | 2500 Hz |
| PE | 500 Hz | 2000 Hz | 3000 Hz |
| PO | 500 Hz | 1200 Hz | 2800 Hz |

Additionally, the voltage controlled type filter 4 is so set, for each case, that the peak thereof may be shifted from 100 Hz, which is the minimum cutoff, to each of those values as shown in the following Table 2 by the attack signal A and is shifted back to each of the sustaining frequencies by the decay signal D.

TABLE 2

| | Sustaining frequency | Attack → / ← Decay | Maximum shift frequency |
|---|---|---|---|
| PA | 100 Hz | → | 1500 Hz |
| | 800 Hz | ← | |
| PI | 100 Hz | → | 1500 Hz |
| | 250 Hz | ← | |
| PU | 100 Hz | → | 1500 Hz |
| | 250 Hz | ← | |
| PE | 100 Hz | → | 1500 Hz |
| | 250 Hz | ← | |
| PO | 100 Hz | → | 1500 Hz |
| | 500 Hz | ← | |

It is preferable that the attack time be 10 ms, and the decay time 20 ms.

Referring to FIG. 1, numeral 11 denotes a low frequency oscillator for vibratomodulation which serves to make the produced sound a more realistic voice sound.

The voltage controlled type filter 4 is provided in front of the formant filter 5 in the illustrated embodiment, but the filter 4 may be connected after the filter 5.

Figure 5:
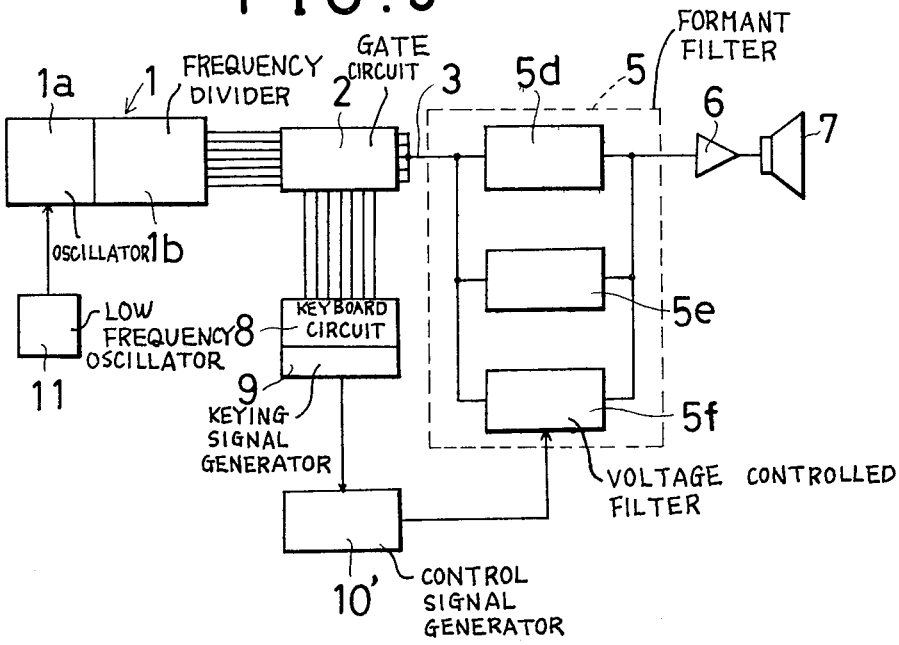
FIG. 5 is a block diagram showing another embodiment of this invention.
Figure 6:
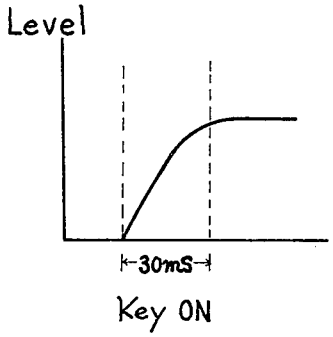
FIG. 6 is an output characteristic diagram of another control signal generator.

FIG. 5 shows a second embodiment of this invention. Therein, control signal generator 10′ connected to the keying signal generator 9 is so constructed that there may be generated therefrom a signal whose output voltage is gradually increased from a time point when a key is depressed and, after about 30 m sec, is set in its sustained condition as shown in FIG. 6. The circuit can be constructed, for instance, as an integration circuit.

Among filters 5*d*, 5*e*, 5*f* constituting the formant filter 5, filter 5*f* is constructed to be a voltage controlled type filter. The remaining parts corresponding to those in FIG. 1 are indicated by the same reference numerals.

Figure 7:
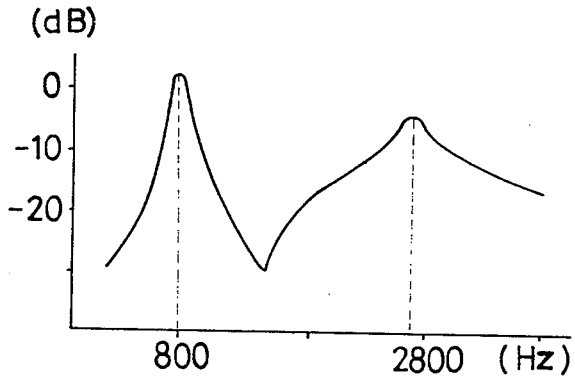
FIG. 7 is a characteristic diagram of filters 5*d*, 5*e*.
Figure 8:
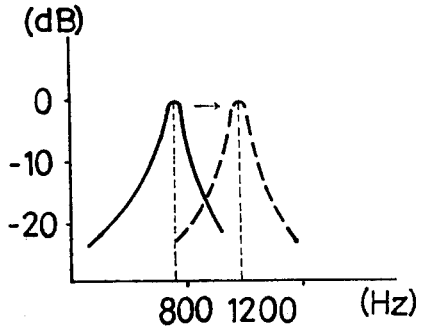
FIG. 8 is a characteristic diagram of filter 5*f*.

It is now intended to produce a vocal sound "RA", the filters 5*d*, 5*e* are to have peaks at 800 Hz and 2800 Hz, respectively as shown in FIG. 7. Additionally, the voltage controlled type filter 5*f* is so set that it ordinarily has its peak at 800 Hz, but its peak is shifted from 800 Hz to 1200 Hz as shown in FIG. 8 by the output of the control signal generator 10′ as shown in FIG. 6.

Figure 9:
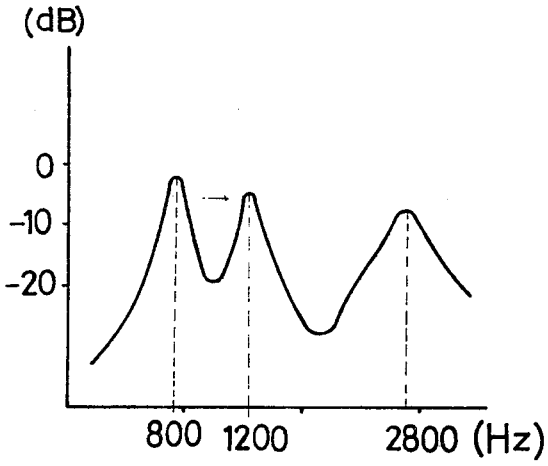
FIG. 9 is a characteristic diagram of the filters 5*d*, 5*e*, 5*f*.

Thus, a sound "R" is generated when a key is depressed, and with lapse of time, the peak of the voltage controlled type filter 5*f* is shifted to 1200 Hz, whereby the sound is changed into the sound "A" having its peaks at 800 Hz, at 1200 Hz and at 2800 Hz as shown in FIG. 9, and as a result the vocal sound "RA" is produced, as a whole, and emitted from the speaker.

For producing the vocal sounds RI, RU, RE, RO, the filters 5*d*, 5*e* are so set as to have their peaks at respective frequencies as shown in the following Table 3, and additionally, the voltage controlled type filter 5*f* is set, for each case, so that its peak is given such a shift as shown in the middle column of Table 3, by the output of the control signal generator 10′.

TABLE 3

| | Filter (5d) | Filter (5f) | Filter (5e) |
|---|---|---|---|
| RA | 800 Hz | 800 Hz → 1200 Hz | 2800 Hz |
| RI | 250 Hz | 800 Hz → 2200 Hz | 3800 Hz |
| RU | 250 Hz | 800 Hz → 1500 Hz | 2500 Hz |
| RE | 500 Hz | 800 Hz → 2000 Hz | 3000 Hz |
| RO | 500 Hz | 800 Hz → 1200 Hz | 2800 Hz |

Figure 10:
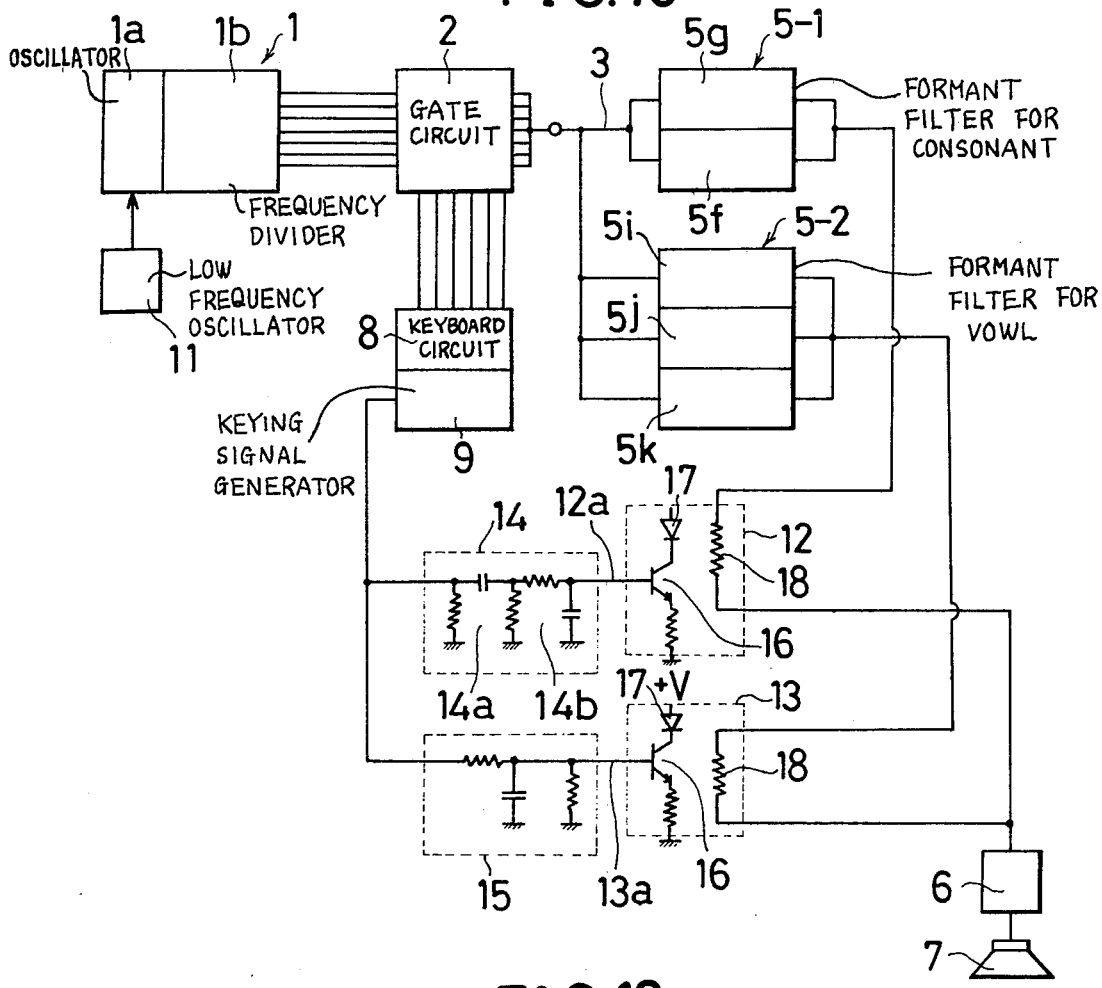
FIG. 10 is a block diagram showing another embodiment of this invention, FIG. 11 (A) is an output characteristic diagram of a keying signal generator, FIG. 11 (B) is an output characteristic diagram of a first control signal generating circuit, FIG. 11 (C) is an output characteristic diagram of a second control signal generating circuit.

FIG. 10 shows a third embodiment of this invention. Therein, a series circuit of a formant filter for a consonant 5-1 and a first gate 12 and a series circuit of a formant filter for a vowel 5-2 and a second gate 13 are connected in parallel to one another in the passing circuit 3, and an output terminal of the keying signal generator 9 is connected to first and second control signal generating circuits 14, 15, respectively. The output terinals of the circuits 14, 15 are connected to respective control electrodes of the first and second gates 12, 13. The first control signal generating circuit 14 comprises a differential circuit 14*a* and an integration circuit 14*b*, and the second control signal generating circuit 15 comprises an integration circuit.

Figure 12:
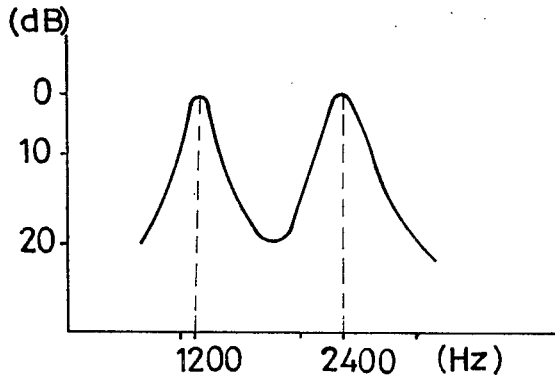
FIG. 12 is a characteristic diagram of a formant filter for a consonant and p

If, by operation of a keyboard, a keying signal as shown in FIG. 11 (A) is generated from the keying signal generator 9, a waveform comprising an attack signal and a decay signal as shown in FIG. 11 (B) is obtained at the output terminal of the first control signal generating circuit 14, and a waveform as shown in FIG. 11 (C) is obtained at the output terminal of the second control signal generating circuit 15. The first and second gates 12, 13 each comprises a transistor 16, a luminous diode 17 connected in series thereto, and a photoconductive element 18 comprising Cds facing the diode 17. The formant filter 5-1 comprises two filters 5*g*, 5*f* and is so set, for instance, in the case of producing a "R" sound, as to have its peak at 1200 Hz and 2400 Hz as shown in FIG. 12. The formant filter 5-2 comprises three filters 5*i*, 5*j*, 5*k* connected in parallel one to another, and is so set as to have its peak at 800 Hz, 1200 Hz and 2800 Hz as shown in FIG. 13. The remaining parts of the circuit are the same as those in FIG. 1 and FIG. 5.

If, now, a keyboard is operated and thereby a corresponding gate in the gate circuit 2 is opened, a musical tone signal is applied to the respective formant filters 5-1 and 5-2. Additionally, a control signal (FIG. 11 (B)) generated from the first control signal generating circuit 14 by the keying signal (FIG. 11 (A)) generated from the keying signal generator 9 serves to open the first gate 12, and thereby a signal passed through the formant filter 5-1 having the characteristics shown in FIG. 12 is allowed to pass therethrough and as a result the sound "R" is produced and is emitted from the speaker 7. The control signal (FIG. 11 (C)) generated from the second control signal generating circuit 15 gradually increases and serves to gradually open the second gate, and thereby a signal passed through the formant filter 5-2 having the filter characteristics as shown in FIG. 3 is gradually allowed to pass therethrough. As a result a vowel sound "A" is produced sequentially to the sound R, and thus the vocal sound "RA" is obtained at the speaker 7.

For obtaining vocal sounds RI,RU,RE,RO, the formant filter 5-1 remains unchanged, while the respective filters 5*i*, 5*j*, 5*k* constituting the formant filter 5-2 are so set as to have their peaks at the frequencies shown in the following Table 4.

TABLE 4

| | Filter (5i) | Filter (5j) | Filter (5k) |
|---|---|---|---|
| RA | 800 Hz | 1200 Hz | 2800 Hz |
| RI | 250 Hz | 2200 Hz | 3800 Hz |
| RU | 250 Hz | 1500 Hz | 2500 Hz |
| RE | 500 Hz | 2000 Hz | 3000 Hz |
| RO | 500 Hz | 1200 Hz | 2800 Hz |

The musical tone oscillator 1 in any of the embodiments shown in FIGS. 1, 5 and 10 is not limited to one comprising the main oscillator 1*a* and the frequency divider l*b*, and substantially the same results can be obtained an arrangement in which the oscillator is a voltage controlled type oscillator, for instance, and the keyboard circuit 8 is formed as a voltage generating circuit for generating a voltage corresponding to a key, so that a so-called synthesizer is constructed. With this arrangement, a keying signal may be received at an output of the voltage generating circuit, or from a keying signal generating circuit provided separately.

What is claimed is:

1. An electronic musical instrument for producing a vocal sound signal comprising musical tone signal generator means, a passing circuit connected to said musical tone signal generator means to pass a musical tone signal produced thereby, key means for selecting the musical tone signal to be fed from the musical tone signal generator means to said passing circuit, formant filter means connected in said passing circuit and including a plurality of filters connected in parallel to one another, and means coupled to said key means and to said formant filter means for producing in said passing circuit, after said formant filter means, two output signals in sequence, upon operation of said key means, one of said output signals being a vowel sound and the other of said output signals being a consonant sound whereby a vocal sound is obtained by the combination of the consonant and vowel sounds in sequence.

2. An electronic musical instrument as claimed in claim 1 comprising low frequency oscillator means coupled to said musical tone signal generator means for vibratomodulating the tone signals produced thereby.

3. An electronic musical instrument as claimed in claim 1 wherein said means for producing two output signals comprises a voltage controlled filter connected in said passing circuit to said formant filter means, said voltage controlled filter having a control electrode, and control signal generating means connected to said key means. for being operated thereby and for producing an output signal having an attack portion and a subsequent decay portion, said control signal generating means having an output connected to said control electrode of said voltage controlled filter to produce a shift in the peak of the filter in sequence upon arrival of the attack portion and the subsequent decay portion.

4. An electronic musical instrument as claimed in claim 3 wherein said output signal has a constant sustaining portion following said decay portion.

5. An electronic musical instrument as claimed in claim 3 wherein the time of attack portion is 10 ms and the time of the decay portion is 20 ms.

6. An electronic musical instrument as claimed in claim 1 wherein said means for producing two output signals comprises a voltage controlled filter constituting one of said filters of said formant filter means and control signal generating means connected to said key means for being operated thereby and connected to said voltage controlled filter to shift the peak of the voltage controlled filter from a lower frequency to a higher frequeny and then to maintain the peak at a sustained frequency.

7. A electronic musical instrument as claimed in claim 6 wherein said control signal generating means includes circuit means for producing an output signal whose voltage gradually increases after a first time interval after operation of said key means and after a second time interval maintains the voltage at a constant value.

8. An electronic musical instrument as claimed in claim 7 wherein said second time interval is 30 m sec.

9. An electronic musical instrument as claimed in claim 1 wherein said formant filter means comprises a first formant filter means for producing a consonant signal and a second formant filter means for producing a vowel signal, said means for producing two output signals in sequence comprising first and second gate means in said passing circuit respectively connected to said first and second formant filter means for controlling passage of output signals therefrom, and first and second control signal generating means coupled to said key means for being operated thereby and connected to said first and second gate means to open said first and second gate means in sequence.

* * * * *

UNITED STATES PATENT AND TRADEMARK OFFICE

CERTIFICATE OF CORRECTION

PATENT NO. : 4,236,434

DATED : December 2, 1980

INVENTOR(S) : Koji Nishibe

It is certified that error appears in the above-identified patent and that said Letters Patent are hereby corrected as shown below:

Please amend Assignee's name to read:

Kabushiki Kaisha Kawai Gakki Seisakusho.

Signed and Sealed this

*Twenty-first* Day of *April 1981*

[SEAL]

*Attest:*

RENE D. TEGTMEYER

*Attesting Officer*

*Acting Commissioner of Patents and Trademarks*